US008832882B2

(12) United States Patent
Roberts et al.

(10) Patent No.: US 8,832,882 B2
(45) Date of Patent: Sep. 16, 2014

(54) MATTRESS HAVING AN ENLARGED SLEEPING SURFACE AREA

(71) Applicant: King Koil Licensing Company, Inc., Willowbrook, IL (US)

(72) Inventors: David J. Roberts, Tinley Park, IL (US); Ross Olinski, Bloomingdale, IL (US); Owen Shoemaker, Alpine, CA (US); Raheel Sadiq, Glendale Heights, IL (US)

(73) Assignee: King Koil Licensing Company, Inc., Willowbrook, IL (US)

( * ) Notice: Subject to any disclaimer, the term of this patent is extended or adjusted under 35 U.S.C. 154(b) by 0 days.

(21) Appl. No.: 14/037,942

(22) Filed: Sep. 26, 2013

(65) Prior Publication Data

US 2014/0090177 A1 Apr. 3, 2014

Related U.S. Application Data

(60) Provisional application No. 61/706,981, filed on Sep. 28, 2012, provisional application No. 61/716,950, filed on Oct. 22, 2012.

(51) Int. Cl.
*A47C 27/00* (2006.01)
*A47C 31/00* (2006.01)

(52) U.S. Cl.
CPC ..... *A47C 31/00* (2013.01); *A47C 27/00* (2013.01)
USPC ..... 5/690; 5/739; 5/400; 5/185

(58) Field of Classification Search
CPC .... A47C 27/00; A47C 27/066; A47C 27/125; A47C 27/142; A47C 27/16
USPC ..... 5/185, 400, 661, 690, 691, 717, 902
See application file for complete search history.

(56) References Cited

U.S. PATENT DOCUMENTS

| | | | | |
|---|---|---|---|---|
| 97,522 A | | 12/1869 | Kittle | |
| 4,271,547 A | * | 6/1981 | Grossutti | 5/181 |
| 4,639,952 A | * | 2/1987 | Kensinger | 5/13 |
| 4,745,646 A | | 5/1988 | Strobel | |
| 5,195,196 A | | 3/1993 | Johenning et al. | |

(Continued)

OTHER PUBLICATIONS

International Search Report and the Written Opinion of The International Searching Authority dated Jun. 13, 2013 with respect to International Patent Application No. PCT/US2013/033298.

*Primary Examiner* — Michael Trettel
(74) *Attorney, Agent, or Firm* — Barnes & Thornburg LLP

(57) ABSTRACT

A mattress comprises an upper surface and a lower surface opposite the upper surface. The mattress further includes first and second opposing side surfaces extending between the upper surface and the lower surface and third and fourth opposing side surfaces extending between the upper surface and the lower surface and between the first and second opposing side surfaces. A core section is formed by the upper and lower surfaces and first and second opposing core section side surfaces and third and fourth opposing core section side surfaces and an extension extends outwardly from a side surface of the core section. The extension is fixedly connected to or integral with the core section and the extension provides the upper surface with a greater area than the lower surface. The extension is capable of supporting a user without a support structure being positioned below the extension.

18 Claims, 3 Drawing Sheets

(56) References Cited

U.S. PATENT DOCUMENTS

| | | | | |
|---|---|---|---|---|
| 6,499,167 | B1 | 12/2002 | Ellis et al. | |
| 6,510,571 | B1 * | 1/2003 | Tittle et al. | 5/400 |
| 6,519,798 | B2 * | 2/2003 | Gladney et al. | 5/690 |
| 6,557,198 | B1 | 5/2003 | Gladney et al. | |
| 6,588,035 | B2 * | 7/2003 | Le Duc et al. | 5/247 |
| 6,601,253 | B1 | 8/2003 | Tarquinio | |
| 6,678,905 | B2 * | 1/2004 | Gladney et al. | 5/400 |
| 7,103,933 | B2 * | 9/2006 | Gladney et al. | 5/690 |
| 7,225,489 | B1 | 6/2007 | Frickey et al. | |
| 7,296,314 | B2 | 11/2007 | Wyatt et al. | |
| 8,024,826 | B2 * | 9/2011 | Gogolev | 5/411 |
| 2003/0093860 | A1 | 5/2003 | Kramer et al. | |
| 2007/0151033 | A1 | 7/2007 | Wyatt et al. | |
| 2011/0252568 | A1 | 10/2011 | Ramp | |

* cited by examiner

MATTRESS HAVING AN ENLARGED SLEEPING SURFACE AREA

CROSS REFERENCE TO RELATED APPLICATIONS

This application claims the benefit of U.S. Provisional Application No. 61/706,981, filed on Sep. 28, 2012, and U.S. Provisional Application No. 61/716,950, filed on Oct. 22, 2012, the disclosures of which are hereby incorporated by reference in their entireties

FIELD OF THE DISCLOSURE

The present disclosure relates generally to mattresses, and more particularly, to mattresses that have an enlarged sleeping surface area.

BACKGROUND OF THE DISCLOSURE

A conventional mattress 10, as depicted in FIG. 1, generally has a rectangular shape. For example, when viewed from above, a plan view of the mattress is rectangular. When viewed from any of four sides of the mattress, side elevational views of the mattress are also rectangular. Conventional mattresses 10 generally sit on a box spring 12, bunkie board, or other support structure.

Oftentimes, a Double or Queen sized bed does not provide enough surface area for two people to sleep comfortably. Many people have therefore turned to purchasing King or California King sized beds, which have larger sleeping surface areas than the Double and Queen sized beds. Other people desire the sleeping surface area of a King or California King sized bed, but do not have a bedroom large enough to hold the footprints of such beds.

One prior art mattress that includes an enlarged surface area is Wyatt et al. U.S. Publication No. 2007/0151033. Wyatt discloses a support surface having a core, a foam perimeter disposed below the core, and a foam topper disposed atop the core and the foam perimeter. The foam perimeter includes an interior well defined by a floor, a top surface, and side walls. The top surface extends beyond a perimeter of the core and the side walls. As seen in FIG. 3 of Wyatt, the mattress must be disposed upon a step deck, which includes a lower deck to support the floor of the foam perimeter, deck side walls to support the side walls of the foam perimeter, and an upper deck to support the top surface of the foam perimeter. While the mattress of Wyatt provides an enlarged sleeping surface area, the step deck is also enlarged and, in fact, has the same length and width dimensions as the mattress to support the entire mattress. There is, therefore, a need for a mattress that does not require a specialized step deck, box spring, or other support surface.

SUMMARY

In illustrative embodiments, a mattress includes an upper surface and a lower surface opposite the upper surface. The mattress further includes first and second opposing end surfaces extending between the upper surface and the lower surface and first and second opposing side surfaces extending between the upper surface and the lower surface and between the first and second opposing side surfaces. The upper surface has an area that is greater than an area of the lower surface.

In other illustrative embodiments, a mattress comprises an upper surface and a lower surface opposite the upper surface. The mattress further includes first and second opposing end surfaces extending between the upper surface and the lower surface and first and second opposing side surfaces extending between the upper surface and the lower surface and between the first and second opposing end surfaces. A core section is formed by the upper and lower surfaces and first and second opposing core section end surfaces and an extension extends outwardly from a side of the core section. The extension is fixedly connected to or integral with the core section and the extension provides the upper surface with a greater area than the lower surface. The extension is capable of supporting a user without a support structure being positioned below the extension.

In further illustrative embodiments, a mattress includes an upper surface, a lower surface, and first and second opposing end surfaces extending between the upper and lower surfaces. First and second opposing side surfaces extend between the upper and lower surfaces and between the first and second opposing end surfaces. The mattress further includes a core section formed by the upper and lower surfaces and first and second opposing core section end surfaces and an extension extending outwardly from a side of the core section. The extension is fixedly connected to or integral with the core section and the extension provides the upper surface with a greater area than the lower surface. Only the lower surface is supported by a support structure.

A better understanding of the objects, advantages, features, properties, and relationships of the disclosure will be obtained from the following detailed description and accompanying drawings which set forth illustrative embodiments that are indicative of the various ways in which the principles of the present disclosure may be employed.

BRIEF DESCRIPTION OF THE DRAWINGS

For a better understanding of the present disclosure, reference may be had to the embodiments shown in the following drawings in which.

DETAILED DESCRIPTION

The present disclosure is directed to a mattress. While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

Figure 1:
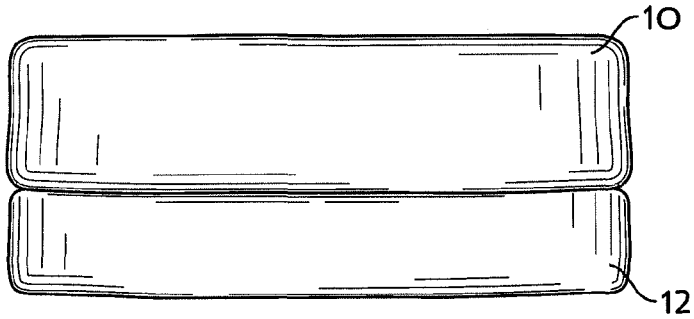
FIG. 1 (Prior Art)
FIG. 1 is a side elevational view of a conventional mattress disposed atop a conventional box spring.
Figure 2:
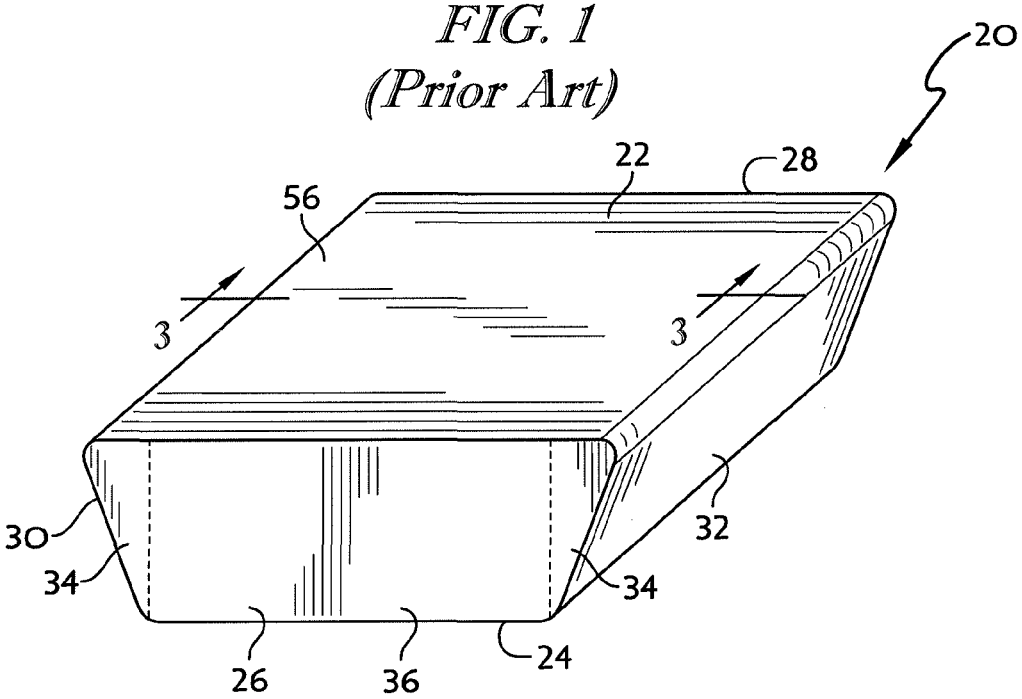
FIG. 2 is a perspective view of a mattress having opposing, generally trapezoidal surfaces and having an upper surface that has a larger surface area than a lower surface of the mattress to provide an increased sleeping surface area.

Turning now to the figures, wherein like reference numerals are used for like elements, there is illustrated in FIGS. 1 and 2 a mattress 20. The mattress 20 includes an upper surface 22 and a lower surface 24, opposing end surfaces 26, 28 extending between the upper and lower surfaces 22, 24, and opposing side surfaces 30, 32 extending between the upper and lower surfaces 22, 24 and extending between the end surfaces 26, 28.

Figure 3:
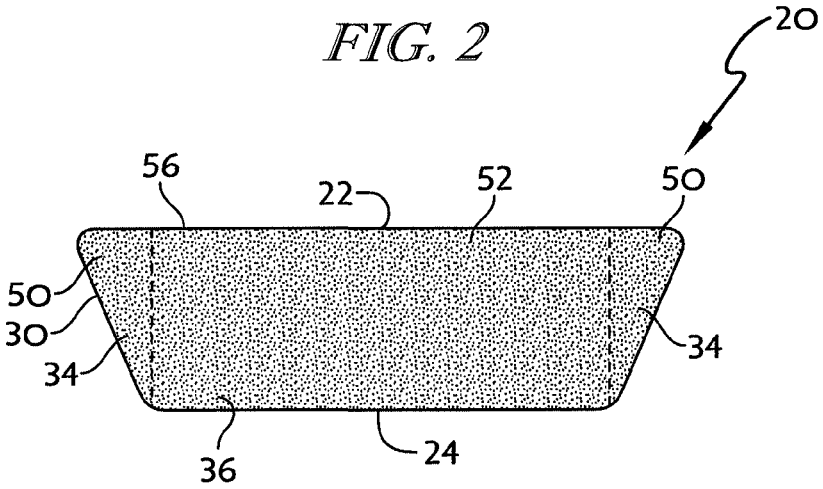
FIG. 3 is a cross-sectional view taken generally along the lines 3-3 of FIG. 2.

Referring to FIGS. 2 and 3, a surface area of the upper surface 22 is greater than a surface area of a lower surface 24 of the mattress 20 to provide an enlarged sleeping surface. The end surfaces 26, 28 have profiles that are generally trapezoidal in shape to create the enlarged sleeping surface area of the upper surface 22.

A first embodiment of a mattress 20 having an enlarged sleeping surface area is depicted in FIGS. 2, 3, 4, and 5A. The mattress 20 includes extensions 34 that, together with a base or core mattress section 36, form the trapezoidal shape of the end surfaces 26, 28. The extensions 34 in this embodiment are triangular in shape. In particular, each of the extensions 34 includes a base leg 40 having a length L1 that forms a portion of the sleeping surface, a support leg 42 having a height H1, and a connecting leg 44 having a length L2.

In an illustrative embodiment, the length L1 of the base leg 40 may be about 3 inches, the height H1 of the support leg 42 may be about 9 inches, and the length L2 of the connecting leg 44 may be between 4 and 15 inches. In such embodiment, an angle A1 formed between the base leg 40 and the connecting leg 44 may be between 20 and 100 degrees. The angle A1 shown in FIG. 5B along with the angle shown in FIG. 5B will increase as H1 and L1 and H2 and L2 increase, respectively. In another illustrative embodiment, the length L1 of the base leg 40 may be about 3 inches, the height H1 of the support leg 42 may be about 10 inches, and the length L2 of the connecting leg 44 may be about 10.4 inches. While particular dimensions are utilized herein, such dimensions should not be considered as limiting. In illustrative embodiments, the base leg 40 may be greater than 0 inches up to about 8 inches. In addition, the height H1 may be any desired height. In illustrative embodiments, the height H1 is between about 4 inches and about 15 inches.

The extensions 34 may include an inner filler material 50, for example, a foam having a firmness of about 1.5 pound 70ILD. Other filler materials may be used including, but are not limited to, natural fibers, synthetic fibers, latex foams, visco-elastic foams, polyurethane foams, gel-infused foams, and/or other suitable filler materials and combinations thereof. The base mattress section 36 may be formed of a foam having a firmness of 1.5 pound 20ILD foam. In this manner, the extensions 34 may have a firmness greater than a firmness of the base mattress section 36, for example between 2 and 5 times the firmness of the base mattress section 36. The range of firmness should be between 20 ILD and 100 ILD and the range of density should be between 1.0 and 2.5 pounds. While the inner filling material 50 of the extensions 34 is disclosed as being different than the inner filler material 52 of the base mattress section 36, the inner filler materials 50, 52 may be made of the same or different filler material(s) and/or may have the same or different firmness levels.

The filler material 50 of the extensions 34 may be formed as part of the mattress 20 or may be formed separately and thereafter attached to the mattress 20. If formed separately, the filler material 50 of the extensions 34 may be attached to the filler material 52 of the mattress 20 by an adhesive or any other suitable attachment mechanism. After the filler materials 50, 52 are attached, the filler materials may thereafter be encased to form the mattress 20 with enlarged surface area.

In a further embodiment, the filler material 52 of the base mattress section 36 may be encased and the filler material 50 of the extensions 34 may be encased. The encased extensions 34 and the encased mattress section 36 may thereafter be attached to one another by adhesive or any other suitable attachment mechanism. Regardless of whether the filler material 50 of the extensions 34 is formed as part of the mattress 20 or formed separately and thereafter attached to the mattress 20, the mattress 20 and extensions 34 only include one or more encased filler materials 50. More specifically, the mattress 20 and extensions 34 do not include any rigid support structures encased therein that aid in supporting a user on the mattress 20.

Figure 4:
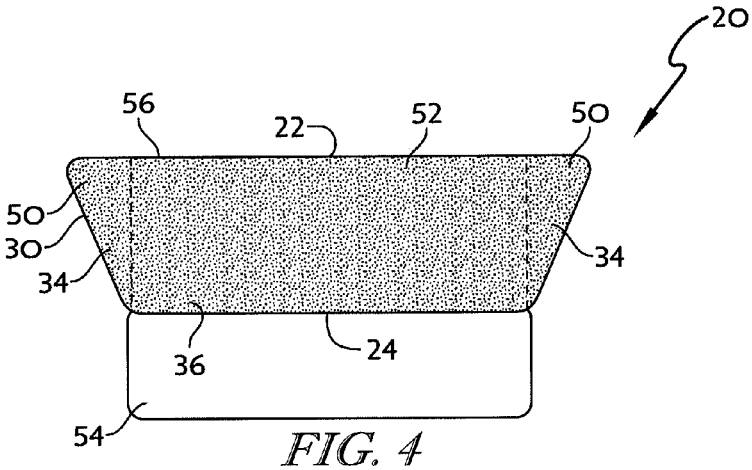
FIG. 4 is a cross-sectional view similar to the view of FIG. 3 and depicting the mattress of FIGS. 2 and 3 atop a support structure.

Referring to FIG. 4, in illustrative embodiments, the mattress 20 may be used in combination with a support structure 54, for example, a bunkie board, a box spring, or any other support structure. As seen in FIG. 4, the mattress 20 is constructed in such a manner that the extensions 34 need not be supported by any structure. As described herein, the extensions 34 function to extend a support surface area 56 upon which a user may rest and will be supported. In this manner, the entire support surface area 56, including the surface area formed by the extension 34 (see L1 in FIG. 5A) is usable by and will support a user.

The mattress 20 may be placed on a support structure 54, as seen in FIG. 4, having one or more length and width dimensions that are the same as, larger than, or smaller than the core mattress section 36. In illustrative embodiments, as seen in FIG. 4, only the lower surface 24 of the mattress 20 must be supported by the support structure 54. The extensions 34 are capable of supporting a user without one or more support structures 54 immediately below or supporting the extensions 34. Similarly, the mattress 20 may be placed on a support structure 54 having one or more length and/or width dimensions that extend beyond one or more edges of the core mattress section 36. In such an illustrative embodiment, the support structure 54 need not be immediately below the extensions 34 to support a user. Rather, the extensions 34 are capable of supporting a user without one or more support structures 54 immediately below or supporting the extensions 34 or without any support members within the mattress 20.

Figure 5A:
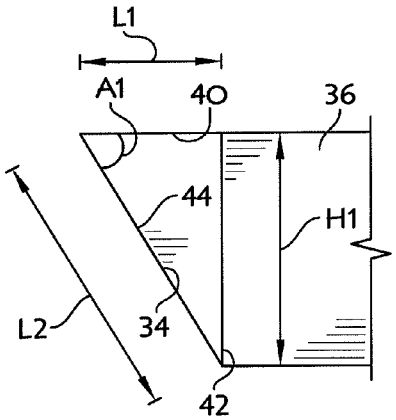
FIGS. 5A-5D are partial side elevational views of further embodiments of mattresses with an increased sleeping surface area.
Figure 5B:
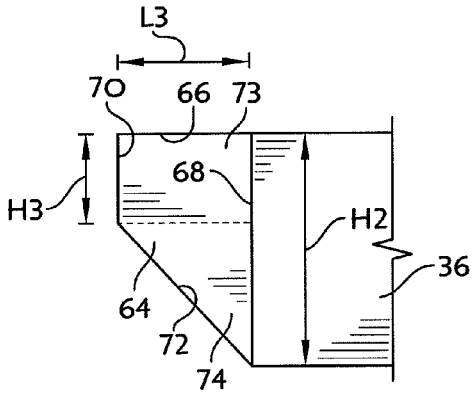

In a second embodiment of the mattress 20, as seen in FIG. 5B, extensions 64 (only one is shown, but an opposite extension is identical) are attached to or formed with the base mattress section 36. The extensions 64 include a base leg 66 having a length L3, an inner support leg 68 having a height H2, an outer support leg 70 having a height H3, and a connecting leg 72 extending between and connecting the inner and outer support legs 68, 70. In illustrative embodiments, the length L3 of the base leg 66 is about 1 to 8 inches, the height H3 of the outer support leg 70 is about 1 to 8 inches, and the height H2 of the inner support leg 68 is between about 4 and about 15 inches. Square and triangular sections 73, 74 are created by the various legs 66, 68, 70, 72. The square and triangular sections 73, 74 may be formed of the same or different filler materials. For example, the materials for the square and triangular sections 73, 74 may have different firmnesses.

Figure 5C:
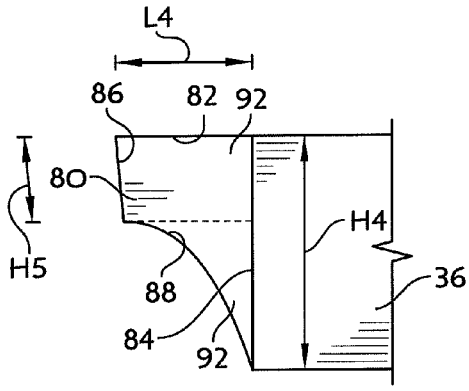
Figure 5D:
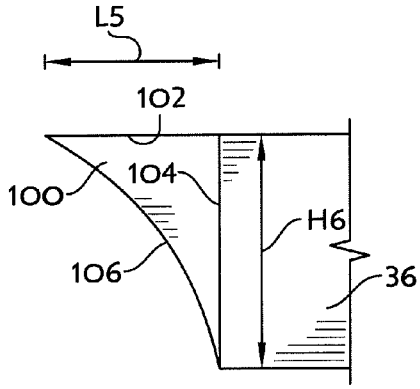

A third embodiment of a mattress 20 is depicted in FIG. 5C, wherein the mattress 20 includes extensions 80 (only one is shown, but an opposite extension is identical) attached to or formed with the base mattress section 36. The extensions 80 include a base leg 82 having a length L4, an inner support leg 84 having a height H4, an outer support leg 86 having a height H5, and a curved connecting leg 88 extending between and connecting the inner and outer support legs 84, 86. The radius of the curved connecting leg 88 is directly proportional to the height H4, H6 and length L4, L5, respectively, as shown in FIGS. 5C and 5D. In an illustrative embodiment, the length L4 of the base leg 82 is about 1 to 8 inches, the height H5 of the outer support leg 86 is about 1 to 8 inches, and the height H4 of the inner support leg 84 is between about 4 and about 15 inches. First and second sections 90, 92 are created by the various legs 82, 84, 86, 88. The first and second sections 90, 92 may be formed of the same or different filler materials. For example, the materials for the first and second sections 90, 92 may have different firmnesses.

A fourth embodiment of a mattress 20 including extensions 100 (only one is shown, but an opposite extension is identical) attached to or formed with the base mattress section 36 is depicted in FIG. 5D. Each of the extensions 100 includes a base leg 102 having a length L5, a support leg 104 having a height H6, and a curved connecting leg 106 extending between and connecting the base and support legs 102, 104. The radius of the curved connecting leg 106 will be directly proportional to the length L5 of base leg 102 and height H6 of support leg 104. In an illustrative embodiment, the length L5 of the base leg 102 is about 1 to 8 inches and the height H6 of the support leg 104 is between about 4 and about 15 inches.

The extensions 64, 80, 100 may include an inner filler material, for example, a foam having a firmness of about 1.5 pound 70ILD. The base mattress sections 36 utilized with the extensions 64, 80, 100 may be formed of a foam having a firmness of 1.5 pound 20ILD foam. In this manner, the extensions 64, 80, 100 may have a firmness greater than a firmness of the base mattress section 36, for example between 2 and 5 times the firmness of the base mattress section 36. While the inner filling material of the extensions 64, 80, 100 is disclosed as being different than the inner filler material of the base mattress section 36, the inner filler materials of the extensions 64, 80, 100 and the base mattress section 36 may be made of the same or different filler material(s) and/or may have the same or different firmness levels.

The filler material of the extensions 64, 80, 100 may be formed as part of the mattress 20 or may be formed separately and thereafter attached to the mattress 20. If formed separately, the filler material of the extensions 64, 80, 100 may be attached to the filler material of the base mattress section 36 by an adhesive or any other suitable attachment mechanism. After the filler materials of the extensions 64, 80, 100 and the base mattress section 36 are attached, the filler materials may thereafter be encased to form the mattress 20 with enlarged surface area.

In further embodiments, the filler material of the base mattress section 36 may be encased and the filler material of the extensions 64, 80, 100 may be encased. The encased extensions 64, 80, 100 and the encased mattress section 36 may thereafter be attached to one another by adhesive or any other suitable attachment mechanism.

Figure 6:
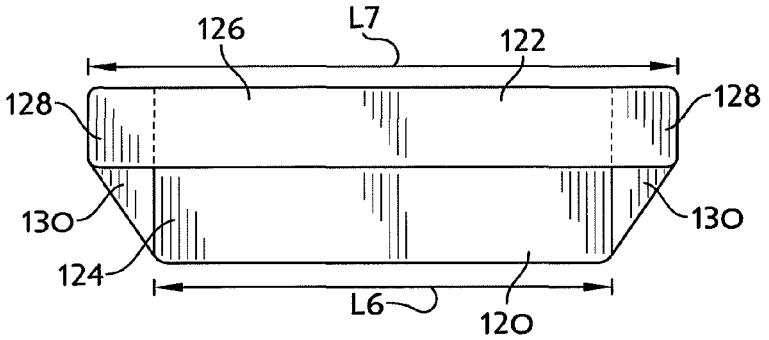
FIG. 6 is a side elevational view of another embodiment of a mattress with an increased sleeping surface area.

Another embodiment of a mattress 20 having an enlarged sleeping surface area is depicted in FIG. 6. The mattress 20 includes first and second base mattress sections 120, 122 having lengths L6 and L7, respectively. The base mattress sections 120, 122 are rectangular in shape and have front end surfaces 124, 126, respectively, and rear end surfaces (not shown) that are generally rectangular in shape. The length L6 is less than the length L7, thereby creating overhang portions 128 of the second base mattress section 122 that extend beyond the first base mattress section 120. Triangular support sections 130 may be formed with or attached to one or both of the first and second base mattress sections 122, 124 below the overhang portions 128 to support the overhang portions 128 and form extensions with the overhang portions 128.

The triangular support sections 130 may be formed as part of one or both of the mattress sections 122, 124 or may be formed separately and thereafter attached to one or both of the mattress sections 122, 124. If formed separately, a filler material of the triangular support sections 130 may be attached to the filler material of one or more of the mattress sections 122, 124 by an adhesive or any other suitable attachment mechanism. After the filler materials are attached, the filler materials may thereafter be encased to form the mattress 20.

Figure 7:
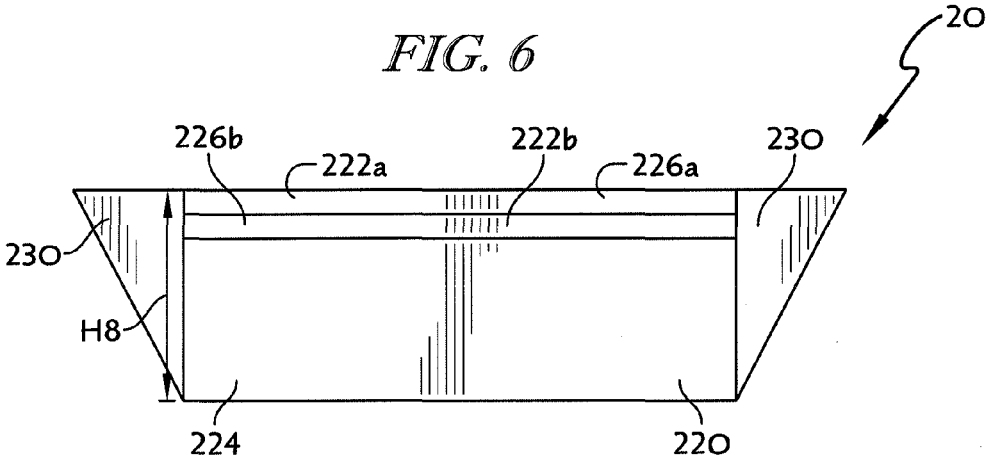
FIG. 7 is a side elevational view of an additional embodiment of a mattress with an increased sleeping surface area and one or more layers.

In yet another embodiment of a mattress 20 having an enlarged sleeping surface area and as depicted in FIG. 7. The mattress 20 may include a base mattress section 220 with one or more layers 222*a*, 222*b* on top of the base mattress section 220. Triangular support sections 230 may be attached to the base mattress section 220 and each of the one or more layers 222. The height H8 of the triangular support section 230 may be equal to the combined height of the base mattress section 220 and all of the one or more layers 222. In this embodiment, the base mattress sections 220 and layers 222 may be rectangular in shape and have front end surfaces 224, 226*a*, 226*b*, respectively, and rear end surfaces (not shown) that are generally rectangular in shape.

Figure 8:
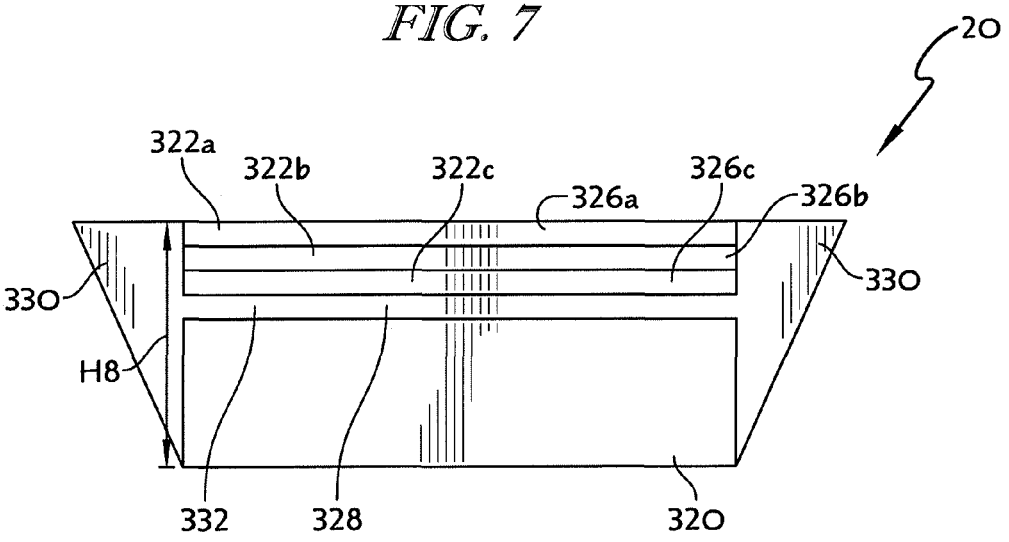
FIG. 8 is a side elevational view of an additional embodiment of a mattress with an increased sleeping surface area and a connecting layer.

In an additional embodiment of a mattress 20 having an enlarged sleeping surface area and as depicted in FIG. 8, the mattress 20 may include a base mattress section 320 with one or more layers 322*a*, 322*b*, 322*c* and a connecting layer 332 that extends between and is integral with one or both of the triangular support sections 330. The layers 322 may rest on top of the connecting layer 332 (as shown in FIG. 8) and the connecting layer 332 will rest atop the base mattress section 320, or the connecting layer 332 may rest on top of the layers 322 (not shown), which may in turn rest atop the base mattress section 320. The height H9 of the triangular support section 330 may be equal to the combined height of the base mattress section 320, all of the one or more layers 322 and the connecting layer 332. In this embodiment, the base mattress sections 320, layers 322 and the connecting layer 332 may be rectangular in shape and have front end surfaces 324, 326*a*, 326*b*, 326*c*, 328 respectively, and rear end surfaces (not shown) that are generally rectangular in shape.

The triangular support sections 330 may be formed as part of one or both of the mattress sections 322, 334 or may be formed separately and thereafter attached to one or both of the mattress sections 322, 324. If formed separately, a filler material of the triangular support sections 330 may be attached to the filler material of one or more of the mattress sections 322, 324 by an adhesive or any other suitable attachment mechanism. After the filler materials are attached, the filler materials may thereafter be encased to form the mattress 20.

In a further embodiment, the filler material of the mattress sections 122, 124 may be individually encased and the filler material of the triangular support sections 130 may be individually encased. The encased triangular sections 130 and the encased mattress sections 122, 124 may thereafter be attached to one another by adhesive or any other suitable attachment mechanism.

The triangular sections 130 may be formed as seen in any of FIGS. 5A-5D. In alternative embodiments, the triangular sections 130 need not be the same shape.

While the extensions forming the opposing surfaces of each mattress herein are described as being the same for a particular mattress, the extensions on a single mattress need not be the same. For example, in one non-limiting embodiment, a first extension forming a first side surface 30 may be as shown in, for example, FIG. 5A and a second extension forming a second side surface 32 may be as shown in, for example, FIG. 5D.

While one particular mattress 20 is depicted herein, the principles of the present application may be applied to any mattress. For example, mattresses employing the enlarged sleeping surface area of the present application may have any size, shape, materials, etc. The principles of the present application may be used for different types of mattresses, for example, foam mattresses, spring mattresses, or any other mattresses, or may be used with a mattress that is used in conjunction with a support, for example, a box spring, a bunkie board, or the like.

While the extensions disclosed herein are shown and disclosed as extending from one or both opposing sides of a mattress, the extensions may additionally or alternatively extend from one or both opposing ends of the mattress. In this manner, the extensions may provide an increased width and/or height to the mattress.

Any of the extensions and base mattress sections disclosed herein may be made of the same or different filler materials. Examples of filler materials include, but are not limited to, open cell foams, closed cell foams, memory foam, gel-infused foams, other foams (latex, polystyrene, polyethylene, etc.), springs, and other suitable fillers, and combinations thereof.

The extensions disclosed herein are intended to enlarge a sleeping surface area of a mattress. The extensions also provide enough support for a user to utilize the extra sleeping surface area without the worry of roll-off or deformation of the extensions, which leads to a user rolling off the edge of the mattress.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive right to all modifications within the scope of the impending claims is expressly reserved. All patents, patent publications and applications, and other references cited herein are incorporated by reference herein in their entirety.

We claim:

1. A mattress comprising:

an upper surface;

a lower surface opposite the upper surface;

first and second opposing side surfaces extending between the upper surface and the lower surface;

third and fourth opposing side surfaces extending between the upper surface and the lower surface and between the first and second opposing side surfaces;

a core section formed by the upper and lower surfaces and first and second opposing core section side surfaces and third and fourth opposing core section side surfaces; and an extension extending outwardly from one of the first, second, third, or fourth core section side surfaces, wherein the extension is fixedly connected to or integral with the core section and the extension provides the upper surface with a greater area than the lower surface;

wherein the extension is triangular and includes a support leg that is disposed adjacent one of the side surfaces of the core section, a base leg extending outwardly from the support leg and coextensive with the upper surface, and a connecting leg extending diagonally between the support leg and the base leg;

wherein the extension is capable of supporting a user without a support structure being positioned below the connecting leg of the extension.

2. The mattress of claim 1, wherein one or more of the side surfaces includes a profile that is generally trapezoidal in shape.

3. The mattress of claim 1, wherein one or more of the side surfaces includes a first segment that is substantially perpendicular to the upper and lower surfaces and a second segment that extends at an angle with respect to the upper and lower surfaces.

4. The mattress of claim 1, wherein at least a portion of one or more of the side surfaces is curved.

5. The mattress of claim 1, wherein an angle formed between the upper surface and a portion of one or more of the side surfaces is about 70 degrees.

6. The mattress of claim 1, wherein one or more of the side surfaces of the core section is rectangular.

7. The mattress of claim 1, wherein the extension is formed separately from the core section and attached to the core section.

8. The mattress of claim 1, wherein the base leg has a length of up to about 3 inches.

9. The mattress of claim 1, wherein the extension has a firmness of between 2 and 5 times a firmness of the core section of the mattress.

10. The mattress of claim 1, wherein the extension extends outwardly from and is connected to one of the core section side surfaces and the mattress further includes:

a second extension connected to and extending outwardly from another of the core section side surfaces, wherein the second extension provides an extended surface area to the upper surface without extending a surface area of the lower surface.

11. The mattress of claim 10, wherein the core section of the mattress includes a connecting layer that extends between and is integral with at least one of the extensions.

12. The mattress of claim 6, wherein the core section of the mattress includes a plurality of layers.

13. The mattress of claim 1, wherein the first and second side surfaces are end surfaces that form a head and a foot of the mattress.

14. A mattress comprising:

an upper surface;

a lower surface opposite the upper surface;

first and second opposing end surfaces extending between the upper surface and the lower surface;

first and second opposing side surfaces extending between the upper surface and the lower surface and between the first and second opposing end surfaces;

a core section formed by the upper and lower surfaces and first and second opposing core section end surfaces; and an extension extending outwardly from a side of the core section, wherein the extension is fixedly connected to or integral with the core section and the extension provides the upper surface with a greater area than the lower surface;

wherein only the lower surface is supported by a support structure; and wherein an angle formed between the upper surface and a portion of at least one of the first and second opposing side surfaces is about 70 degrees.

15. The mattress of claim 14, wherein the extension has a firmness of between 2 and 5 times a firmness of the core section of the mattress.

16. The mattress of claim 14, wherein the extension extends outwardly from and is connected to the first core section side surface and the mattress further includes:

a second extension connected to and extending outwardly from the second core section side surface, wherein the second extension provides an extended surface area to the upper surface without extending a surface area of the lower surface.

17. The mattress of claim 14, wherein the core section of the mattress includes a connecting layer that extends between and is integral with at least one of the extensions.

18. A mattress comprising:

an upper surface;

a lower surface opposite the upper surface;

first and second opposing side surfaces extending between the upper surface and the lower surface;

third and fourth opposing side surfaces extending between the upper surface and the lower surface and between the first and second opposing side surfaces;

a core section formed by the upper and lower surfaces and first and second opposing core section side surfaces and third and fourth opposing core section side surfaces; and an extension extending outwardly from one of the first, second, third, or fourth core section side surfaces, wherein the extension is fixedly connected to or integral with the core section and the extension provides the upper surface with a greater area than the lower surface;

wherein the extension is capable of supporting a user without a support structure being positioned below the extension; and wherein at least a portion of one or more of the side surfaces is curved.

* * * * *